US011810521B1

(12) United States Patent
Liu et al.

(10) Patent No.: US 11,810,521 B1
(45) Date of Patent: Nov. 7, 2023

(54) DISPLAY DRIVE METHOD FOR REDUCING DIFFERENCE BETWEEN LIGHT EMITTING EFFICIENCIES OF SUBPIXELS, DISPLAY DRIVER, AND DISPLAY DEVICE

(71) Applicant: Wuhan Tianma Micro-Electronics Co., Ltd., Wuhan (CN)

(72) Inventors: Xigang Liu, Wuhan (CN); Shuo Tang, Wuhan (CN); Zhihua Yu, Wuhan (CN); Xiangyu Gao, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/871,289

(22) Filed: Jul. 22, 2022

(30) Foreign Application Priority Data

Apr. 25, 2022 (CN) ..... 202210439038.3

(51) Int. Cl.
*G09G 3/3291* (2016.01)

(52) U.S. Cl.
CPC ... *G09G 3/3291* (2013.01); *G09G 2300/0452* (2013.01); *G09G 2300/0842* (2013.01); *G09G 2310/027* (2013.01)

(58) Field of Classification Search
CPC ..... G09G 3/3291
USPC ..... 345/204
See application file for complete search history.

(56) References Cited

U.S. PATENT DOCUMENTS

2019/0189045 A1* 6/2019 Hwang ..... G09G 3/2003
2019/0392769 A1* 12/2019 Lee ..... G09G 3/3291

FOREIGN PATENT DOCUMENTS

CN 110060649 A 7/2019
CN 111785209 A 10/2020
CN 111798799 A 10/2020

* cited by examiner

*Primary Examiner* — Long D Pham
(74) *Attorney, Agent, or Firm* — ANOVA LAW GROUP PLLC

(57) ABSTRACT

A display drive method is applied to a display panel. The display panel has a subpixel used for image display. The display drive method includes obtaining a to-be-displayed grayscale of a to-be-displayed subpixel, selecting a suitable compensation manner based on the to-be-displayed grayscale, and providing a data voltage for the to-be-displayed sub-pixel based on the selected compensation manner. The compensation manner includes a first compensation manner and a second compensation manner. When the to-be-displayed grayscale is 0 grayscale, the first compensation manner is selected. When the to-be-displayed grayscale is greater than 0 grayscale, the second compensation manner is selected. The first compensation manner is used to reduce a difference between light-emitting efficiencies of sub-pixels with different light-emitting colors under a same grayscale.

16 Claims, 5 Drawing Sheets

DISPLAY DRIVE METHOD FOR REDUCING DIFFERENCE BETWEEN LIGHT EMITTING EFFICIENCIES OF SUBPIXELS, DISPLAY DRIVER, AND DISPLAY DEVICE

CROSS-REFERENCE TO RELATED APPLICATION

This application claims priority to Chinese Patent Application No. 202210439038.3, filed on Apr. 25, 2022, the entire content of which is incorporated herein by reference.

TECHNICAL FIELD

The present disclosure relates to the image display technology field and, more particularly, to a display drive method, a display driver, and a display device.

BACKGROUND

With the continuous development of scientific technology, more and more display devices are widely used, which bring great convenience and have become essential tools.

A main member of the display device that realizes a display function is a display panel. An organic light-emitting diode (OLED) display panel displays an image through an OLED element with a self-light-emitting function, which has advantages of no backlight, high contrast, a thin thickness, a wide viewing angle, a fast response speed, application for a flexible panel, and a wide operating temperature range, and a simple structure and manufacturing process. Thus, the OLED display panel becomes one of the current mainstream display panels.

In the existing OLED display panel, a display color deviation problem exists. Although the display color deviation problem is solved with a display compensation method to a certain degree, the conventional display compensation method has a limited effect on solving the color deviation problem.

SUMMARY

Embodiments of the present disclosure provide a display drive method. The display drive method is applied to a display panel. The display panel has a subpixel used for image display. The method includes obtaining a to-be-displayed grayscale of a to-be-displayed subpixel, selecting a suitable compensation manner based on the to-be-displayed grayscale, and providing a data voltage for the to-be-displayed sub-pixel based on the selected compensation manner. The compensation manner includes a first compensation manner and a second compensation manner. When the to-be-displayed grayscale is 0 grayscale, the first compensation manner is selected. When the to-be-displayed grayscale is greater than 0 grayscale, the second compensation manner is selected. The first compensation manner is used to reduce a difference between light-emitting efficiencies of sub-pixels with different light-emitting colors under a same grayscale.

Embodiments of the present disclosure provide a display driver, including a first acquisition module, a first determination module, and a compensation drive module. The first acquisition module is configured to obtain a to-be-displayed grayscale of a to-be-displayed sub-pixel. The first determination module is configured to select a suitable compensation manner based on the to-be-displayed grayscale. The compensation drive module is configured to provide a data voltage for the to-be-displayed sub-pixel based on the selected compensation manner. The compensation manner includes a first compensation manner and a second compensation manner. When the to-be-displayed grayscale is 0 grayscale, the first compensation manner is selected. When the to-be-displayed grayscale is greater than 0 grayscale, the second compensation manner is selected. The first compensation manner is used to reduce a difference between light-emitting efficiencies of sub-pixels with different light-emitting colors under a same grayscale.

Embodiments of the present disclosure provide a display driver, including a display panel and a display driver. The display driver includes a first acquisition module, a first determination module, and a compensation drive module. The first acquisition module is configured to obtain a to-be-displayed grayscale of a to-be-displayed sub-pixel. The first determination module is configured to select a suitable compensation manner based on the to-be-displayed grayscale. The compensation drive module is configured to provide a data voltage for the to-be-displayed sub-pixel based on the selected compensation manner. The compensation manner includes a first compensation manner and a second compensation manner. When the to-be-displayed grayscale is 0 grayscale, the first compensation manner is selected. When the to-be-displayed grayscale is greater than 0 grayscale, the second compensation manner is selected. The first compensation manner is used to reduce a difference between light-emitting efficiencies of sub-pixels with different light-emitting colors under a same grayscale.

DETAILED DESCRIPTION OF THE EMBODIMENTS

Embodiments of the present disclosure are described in detail below in connection with the accompanying drawings of embodiments of the present disclosure. Apparently, described embodiments are only some embodiments of the present disclosure, but not all embodiments. Based on embodiments of the present disclosure, all other embodiments obtained by those of ordinary skill in the art without creative efforts should be within the scope of the present disclosure.

For an organic light-emitting diode (OLED) display panel, a pixel unit may include a red sub-pixel R, a green sub-pixel G, and a blue sub-pixel B. The OLED display panel may use an OLED element as a sub-pixel to display an image. In order to improve a display effect, pixel rendering may be used to perform display driving. Neighboring pixel units may have shared sub-pixels. A driving circuit may be in a row, and RGBG may be alternately arranged. Display brightnesses of RGB cannot be individually controlled. Moreover, a client specification requirement for display quality includes 0~W255≥65%. That is, when white light is displayed, the display brightnesses of 0 grayscale and 255 grayscale should be greater than or equal to 65%. The client specification requirement for display quality further includes a difference among 0~RGB 255<12%. That is, when the three RGB sub-pixels are displayed in a grayscale from 0 to 255, a brightness difference when the sub-pixels of different colors are displayed in a same grayscale needs to be less than 12%.

The display panel has a smear problem and a color deviation problem. The inventor found that in the OLED display panel, when the three RGB sub-pixels emit light and are displayed in a low grayscale, light-emitting efficiency may decay at different speeds, which results in the smear color deviation problem and cannot satisfy a determined specification requirement.

Figure 1:
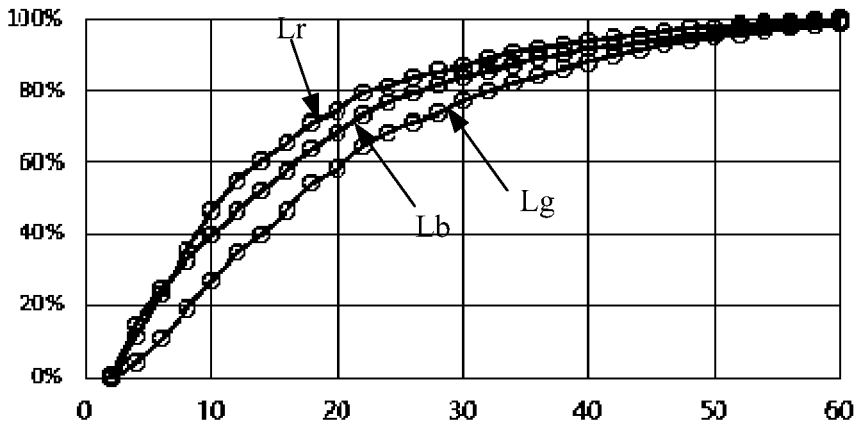
FIG. 1 is a schematic graph of a light-emitting efficiency of three RGB sub-pixels in an OLED display panel according to some embodiments of the present disclosure.

FIG. 1 is a schematic graph of a light-emitting efficiency of three RGB sub-pixels in the OLED display panel according to some embodiments of the present disclosure. A horizontal axis represents a grayscale value, and a vertical axis represents normalized light-emitting efficiency. Lr represents a light-emitting efficiency curve of a red sub-pixel R. Lg represents a light-emitting efficiency curve of a green sub-pixel G. Lb represents a light-emitting efficiency curve of a blue sub-pixel B. RGB uses a same 0 grayscale data voltage VGMP. When RGB is at a low grayscale, relatively large differences exist among light-emitting efficiency decay rates, which causes the smear color deviation problem.

The light-emitting efficiency of the green sub-pixel G may have a largest decay rate at the low grayscale. Since a neighboring red sub-pixel R and a blue sub-pixel B in the same row share a same data line, and the green sub-pixel G uses a data line individually, an aperture ratio of the green sub-pixel G may be larger. Thus, a current density of the green sub-pixel G may become lower, and the light-emitting efficiency decay rate may be faster at the low grayscale.

An existing compensation method may use external optical compensation (Demura) to perform display compensation on the OLED display panel to solve the display color deviation problem. In the compensation manner, the compensation may be performed based on a gamma curve. RGB may use a same 0 grayscale data voltage, that is a standard dark state data voltage VGMP below. The standard dark state data voltage VGMP may be a determined constant voltage. When the data voltage input by the sub-pixel is not greater than VGMP, the sub-pixel may be at 0 grayscale.

In the existing compensation method, when the compensation is performed at the low grayscale, a compensation grayscale may be obtained by performing interpolation calculation based on a normal gamma curve. However, in practical applications, the 0 grayscale of the gamma curve may not be a calibrated grayscale. As mentioned above, the standard dark state data voltage VGMP may be a voltage constant that is set based on a manufacturer display requirement. Because the standard dark state data voltage VGMP is not a calibrated grayscale on the normal gamma curve, the existing compensation method cannot effectively solve the display color deviation problem of the low grayscale.

Thus, embodiments of the present disclosure provide a display drive method, a display driver, and a display device. In the technical solutions of the present disclosure, a suitable compensation manner may be selected based on a to-be-displayed grayscale of a to-be-displayed sub-pixel to provide a data voltage for the to-be-displayed sub-pixel. The compensation manner may include a first compensation manner and a second compensation manner. If the to-be-displayed grayscale is 0 grayscale, the first compensation manner may be selected. If the to-be-displayed grayscale is greater than 0 grayscale, the second compensation method may be selected. The first compensation manner may be used to reduce a difference between light-emitting efficiencies of sub-pixels with different light-emitting colors under the same grayscale.

In the technical solution of the present disclosure, the display compensation may be performed on the to-be-displayed sub-pixel at the 0 grayscale by the first compensation manner, and the display compensation may be performed on the to-be-displayed sub-pixels at a non-zero grayscale greater than 0 grayscale by the second compensation manner. In the first compensation manner, the difference between the light-emitting efficiencies of the sub-pixels of different light-emitting colors may be reduced. Thus, the display color deviation problem caused by different light-emitting efficiency decay rates may be solved when the sub-pixels of different light-emitting colors are at the low grayscale.

In order to make the above purposes, features, and advantages of the present disclosure clearer, the present disclosure is further described in detail below in connection with the accompanying drawings and specific embodiments.

Figure 2:
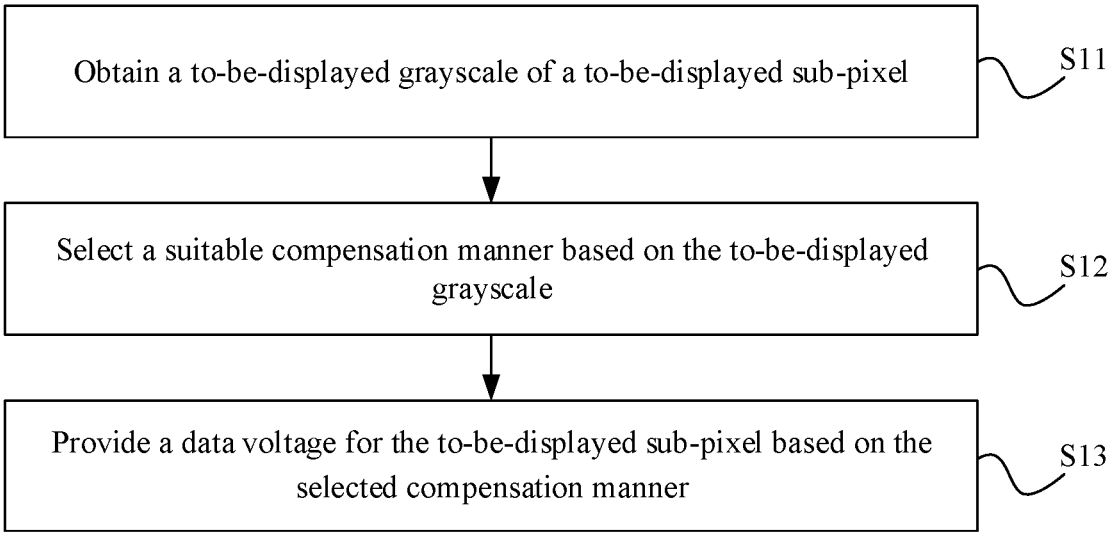
FIG. 2 is a schematic flowchart of a display drive method according to some embodiments of the present disclosure.

FIG. 2 is a schematic flowchart of a display drive method according to some embodiments of the present disclosure. The display drive method is used for a display panel. The display panel may include an OLED display panel. The display panel may include a sub-pixel used to display an image. The sub-pixel may be an OLED element.

As shown in FIG. 2, the display drive method includes obtaining a to-be-displayed grayscale of a to-be-displayed sub-pixel (S11), selecting a suitable compensation manner based on the to-be-displayed grayscale (S12), and providing a data voltage for the to-be-displayed sub-pixel based on the selected compensation manner.

The compensation manner may include a first compensation manner and a second compensation manner. If the to-be-displayed grayscale is 0 grayscale, the first compensation manner may be selected. If the to-be-displayed grayscale is greater than 0 grayscale, the second compensation method may be selected. The first compensation manner may be used to reduce the difference between the light-emitting efficiencies of the sub-pixels with different light-emitting colors under the same grayscale.

In the display drive method of the present disclosure, the display compensation may be performed on the to-be-displayed sub-pixel at the 0 grayscale by the first compensation manner, and the display compensation may be performed on the to-be-displayed sub-pixels at a non-zero grayscale greater than 0 grayscale by the second compensation manner. In the first compensation manner, the difference between the light-emitting efficiencies of the sub-pixels of different light-emitting colors may be reduced. Thus, the display color deviation problem caused by different light-emitting efficiency decay rates may be solved when the sub-pixels of different light-emitting colors are at the low grayscale.

Figure 3:
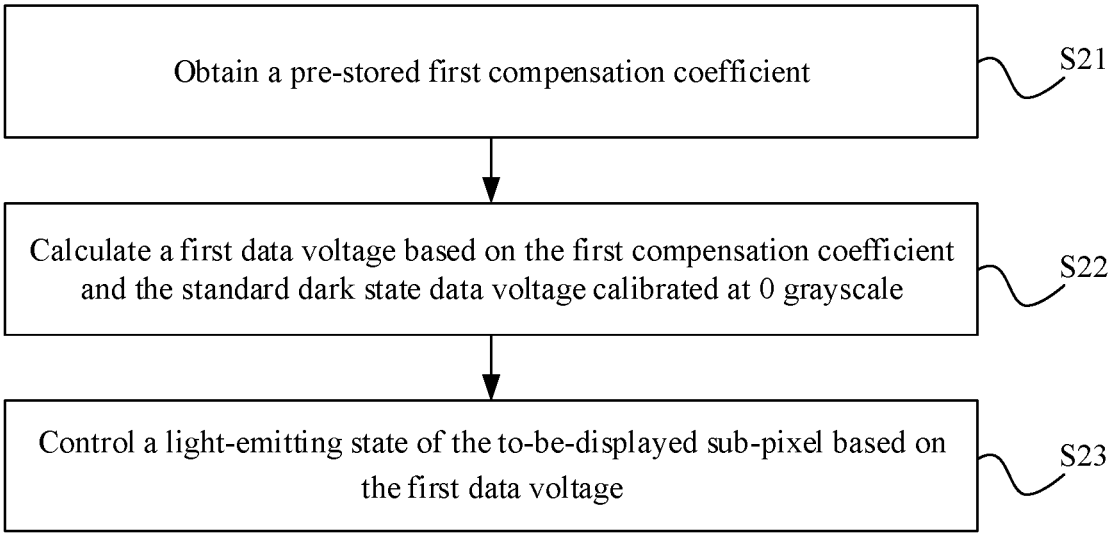
FIG. 3 is a schematic flowchart of a method for providing a data voltage for a to-be-displayed sub-pixel based on a first compensation manner according to some embodiments of the present disclosure.

In embodiments of the present disclosure, when the to-be-displayed grayscale is the 0 grayscale, based on the first compensation manner, a method for providing a data voltage for the to-be-displayed sub-pixel is shown in FIG. 3.

FIG. 3 is a schematic flowchart of the method for providing the data voltage for the to-be-displayed sub-pixel based on the first compensation manner according to some embodiments of the present disclosure. The method includes obtaining a pre-stored first compensation coefficient (S21), calculating a first data voltage based on the first compensation coefficient and the standard dark state data voltage calibrated at 0 grayscale (S22), and controlling a light-emitting state of the to-be-displayed sub-pixel based on the first data voltage (S23).

The first data voltage may be different from the standard dark-state data voltage, so as to change the light-emitting efficiency of the sub-pixel and reduce the difference between the light-emitting efficiencies of the sub-pixels with different light-emitting colors.

The manufacturer may perform a light-emitting test on the display panel to determine the first compensation coefficient based on actual light-emitting brightnesses of the sub-pixels of different light-emitting colors under a test grayscale and the determined standard dark state data voltage VGMP.

First compensation coefficients corresponding to the three sub-pixels may be different. By setting different first compensation coefficients, amplitudes of the light-emitting differences of the three sub-pixels may be reduced during a picture switch process. Thus, the smear color deviation problem may be compensated and improved. The first compensation coefficients corresponding to the three sub-pixels may be determined by the compensation coefficients recorded in a grayscale memory or directly testing actual dark state data voltages of the three sub-pixels at 0 grayscale.

The display panel may include a first sub-pixel, a second sub-pixel, and a third sub-pixel with different light-emitting colors from each other. The first compensation coefficients of the three sub-pixels may not be the same. By adjusting the first compensation coefficients and performing the compensation on the determined standard dark state data voltages calibrated at 0 grayscale of the sub-pixels, 0 grayscale data voltages of the three sub-pixels may not be the same. By setting the first compensation coefficients, a light-emitting efficiency curve of a sub-pixel with a larger low grayscale light-emitting efficiency decay rate may be moved upward. Thus, the difference between the light-emitting efficiencies of the sub-pixels with different colors at the low grayscale may be reduced. The display color deviation problem may be solved, and the smear color deviation problem may be improved.

The standard dark state data voltage may be VGMP. VGMP may be a determined voltage constant. The sub-pixels of different colors may have the same standard dark state data voltage VGMP.

Thus, a method for calculating the first data voltage may include that the first data voltage is equal to the first compensation coefficient plus the standard dark state data voltage. In some embodiments, the first compensation coefficient may be denoted by A, and the first data voltage may be denoted by V1, then the first data voltage denoted by V1 is shown in the following formula.

$$V1=\mathrm{VGMP}+A$$

wherein A is a pre-stored voltage constant, which may be a positive number or a negative number based on a compensation requirement.

In the technical solution of embodiments of the present disclosure, based on the set first compensation coefficient A and the standard dark state data voltage VGMP, and the first data voltage of the to-be-displayed sub-pixel at 0 grayscale may be obtained through a simple addition operation.

The display panel may include the first sub-pixel, the second sub-pixel, and the third sub-pixel with different light-emitting colors. The light-emitting efficiency decay rates of the first sub-pixel, the second sub-pixel, and the third sub-pixel may decrease in sequence when the to-be-displayed grayscale is smaller than a low grayscale threshold. The first sub-pixel may be set as the red sub-pixel R, the second sub-pixel may be set as the blue sub-pixel B, and the third sub-pixel may be set as the green sub-pixel G. As shown in FIG. 1, when the light-emitting efficiencies of the red sub-pixel R, the blue sub-pixel B, and the green sub-pixel G are less than 50 and decrease in sequence. The low grayscale threshold may not be limited to 50. Based on different design parameters of the display panel, the low grayscale threshold may have different values, which are not limited in embodiments of the present disclosure.

In order to solve the display color deviation problem caused by inconsistent light-emitting efficiency decay rates at the low grayscale when the three sub-pixels with different light-emitting colors use the same 0 grayscale data voltage VGMP, in the technical solution of the present disclosure, the first compensation coefficient corresponding to the first sub-pixel may be set to be greater than 0. Thus, the actual data voltage (i.e., the first data voltage) of the first sub-pixel at 0 grayscale may be greater than the standard dark-state data voltage VGMP. Therefore, the light-emitting efficiency curve corresponding to the first sub-pixel may be shifted downward. The decay rate of the light-emitting efficiency curve at the same grayscale may remain unchanged, but the light-emitting efficiency may decrease. Thus, the difference between the light-emitting efficiencies of the first sub-pixel and the second sub-pixel at the same grayscale may be reduced, which may reduce the display color deviation. In addition or in some embodiments, the first compensation coefficient corresponding to the third sub-pixel may be smaller than 0. Thus, the actual data voltage (i.e., the first data voltage) of the third sub-pixel at the grayscale may be smaller than the standard dark-state data voltage VGMP. Therefore, the light-emitting efficiency curve corresponding to the third sub-pixel may be shifted upward. The decay rate of the light-emitting efficiency curve at the same grayscale may remain unchanged, and the light-emitting efficiency may increase. Thus, the difference between the light-emitting efficiencies of the third sub-pixel and the second sub-pixel at the same grayscale may be reduced, and the display color deviation may be reduced.

By setting the first compensation coefficient corresponding to the third sub-pixel to be less than 0, a drive voltage of the third sub-pixel may be reduced. By satisfying that the third sub-pixel will not be turned on at 0 grayscale, the dark state voltage of the third sub-pixel may need to be reduced as much as possible to increase the light-emitting efficiency of the third sub-pixel in the picture switch process. Thus, the smear color deviation problem may be reduced because the brightness of the third sub-pixel is low due to the low light-emitting efficiency and the low aperture ratio.

The first sub-pixel may be set as the red sub-pixel R, the second sub-pixel may be set as the blue sub-pixel B, and the third sub-pixel may be set as the green sub-pixel G. Since the first compensation coefficient corresponding to the red sub-pixel R is greater than 0, the light-emitting efficiency curve Lr corresponding to the red sub-pixel R may be shifted downward at the position shown in FIG. 1. The decay rate of the light-emitting efficiency curve Lr at the same grayscale may remain unchanged. The light-emitting efficiency may be reduced. By selecting a suitable first compensation coefficient, a difference between the light-emitting efficiencies between the red sub-pixel R and the blue sub-pixel B at the same grayscale may be reduced. Thus, the display color deviation may be reduced. Since the first compensation coefficient corresponding to the green sub-pixel G is less than 0, the light-emitting efficiency curve Lg corresponding to the green sub-pixel G may be shifted upward at the position shown in FIG. 1. The decay rate of the light-emitting efficiency curve Lg at the same grayscale may remain unchanged. The light-emitting efficiency may be increased. By selecting a suitable first compensation coefficient, a difference between the light-emitting efficiencies of the green sub-pixel G and the blue sub-pixel B can be reduced at the same grayscale. Thus, the display color deviation may be reduced.

In embodiments of the present disclosure, the first compensation coefficient corresponding to the second sub-pixel may be set to be 0. When the to-be-displayed grayscale is smaller than the low grayscale threshold, for the same to-be-displayed grayscale, the light-emitting efficiency decay rates of the first sub-pixel, in the light-emitting efficiency decay rate of the second sub-pixel, the first compensation coefficient corresponding to the second sub-pixel may be set to be 0. When the display compensation is performed, the light-emitting efficiencies of the first sub-pixel and the third sub-pixel may be caused to approach the light-emitting efficiency of the second sub-pixel, which may simplify a drive manner and a calculation process.

If the second sub-pixel is set to be the blue sub-pixel B, based on FIG. 1, if RGB adopts the same standard dark state data voltage VGMP, when the to-be-displayed grayscale displays the low grayscale threshold, the same grayscale to be displayed corresponds to the same grayscale threshold, for the same to-be-displayed grayscale, the light-emitting efficiency decay rate of the blue sub-pixel B may be in the middle. When the display compensation is performed, the light-emitting efficiencies of the red sub-pixel R and the green sub-pixel G may be caused to approach the light-emitting efficiency of the blue sub-pixel B, which may simplify the drive manner and the calculation process.

Figure 4:
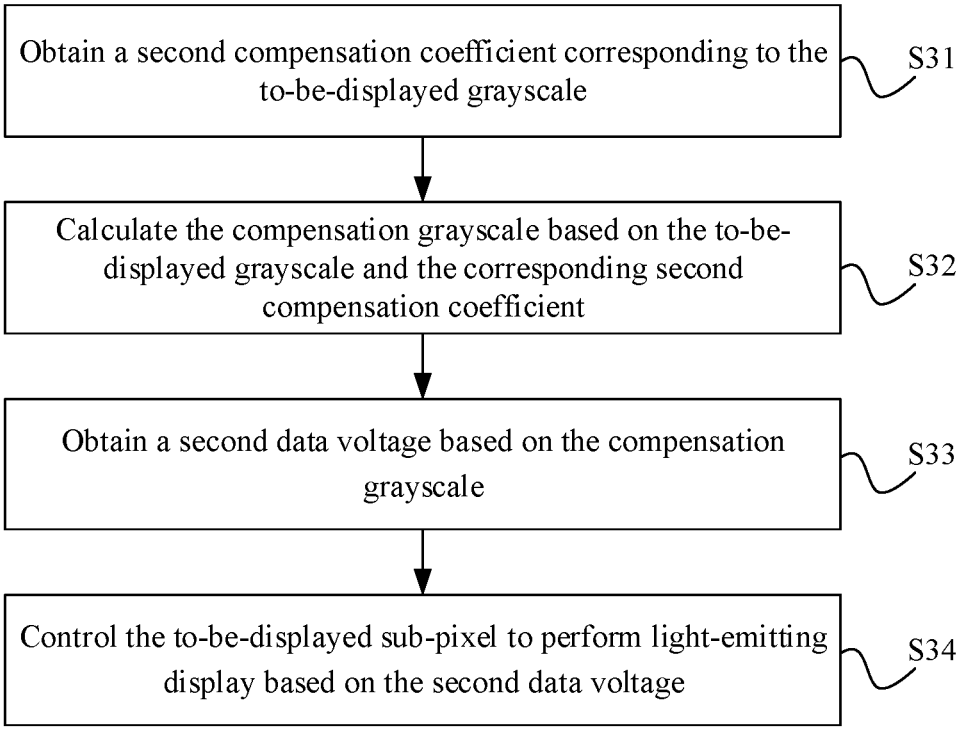
FIG. 4 is a schematic flowchart of a method for providing a data voltage for a to-be-displayed sub-pixel based on a second compensation manner according to some embodiments of the present disclosure.

In embodiments of the present disclosure, when the to-be-displayed displayed grayscale is greater than 0 grayscale, based on the second compensation manner, a method for providing a data voltage for a to-be-displayed sub-pixel is shown in FIG. 4.

FIG. 4 is a schematic flowchart of a method for providing the data voltage for the to-be-displayed sub-pixel based on the second compensation manner according to some embodiments of the present disclosure. The method includes obtaining a second compensation coefficient corresponding to the to-be-displayed grayscale (S31), calculating the compensation grayscale based on the to-be-displayed grayscale and the corresponding second compensation coefficient (S32), obtaining a second data voltage based on the compensation grayscale (S33), and controlling the to-be-displayed sub-pixel to perform light-emitting display based on the second data voltage (S34).

Through the method shown in FIG. 4, the compensation grayscale is calculated based on the to-be-displayed grayscale and the corresponding second compensation coefficient. The second data voltage may be determined based on the compensation grayscale. The to-be-displayed sub-pixel may be controlled to perform light-emitting display based on the second data voltage. When the to-be-displayed grayscale is greater than 0, compensation may be performed on the to-be-displayed grayscale to convert the to-be-displayed grayscale into the compensation grayscale to drive the light-emitting display. Thus, the display color deviation problem for the to-be-displayed grayscale greater than 0 may be reduced.

In the display drive method of embodiments of the present disclosure, the sub-pixels of different light-emitting colors may have the same second compensation coefficient when the to-be-displayed grayscale is the same. Thus, the second compensation manner may be the same as the Demura compensation manner based on the gamma curve. When the to-be-displayed grayscale is greater than 0, and the second compensation manner is used to perform display compensation, the sub-pixels with different light-emitting colors may correspond to the same second compensation coefficient at the same to-be-displayed grayscale.

The method for calculating the compensation grayscale may include that the compensation grayscale is equal to a sum of the to-be-displayed grayscale and the corresponding second compensation coefficient.

In the technical solution of embodiments of the present disclosure, the compensation grayscale may be obtained through a simple addition operation based on the to-be-displayed grayscale and the corresponding second compensation coefficient.

Second compensation coefficients corresponding to a plurality of different first standard grayscales may be pre-stored. Second data voltages corresponding to a plurality of different second standard grayscales may be pre-stored. The manufacturer may perform the light-emitting test on the display panel to determine the second compensation coefficients corresponding to the plurality of different first standard grayscales and the second data voltages corresponding to the plurality of different second standard grayscales.

In order to reduce a data collection amount and a data processing amount of the light-emitting test, some grayscales may be selected from 1-255 as the first standard grayscales to determine the corresponding second compensation coefficients. Therefore, in the method shown in FIG. 4, a method for obtaining the second compensation coefficient corresponding to the to-be-displayed grayscale may be shown in FIG. 5.

Figure 5:
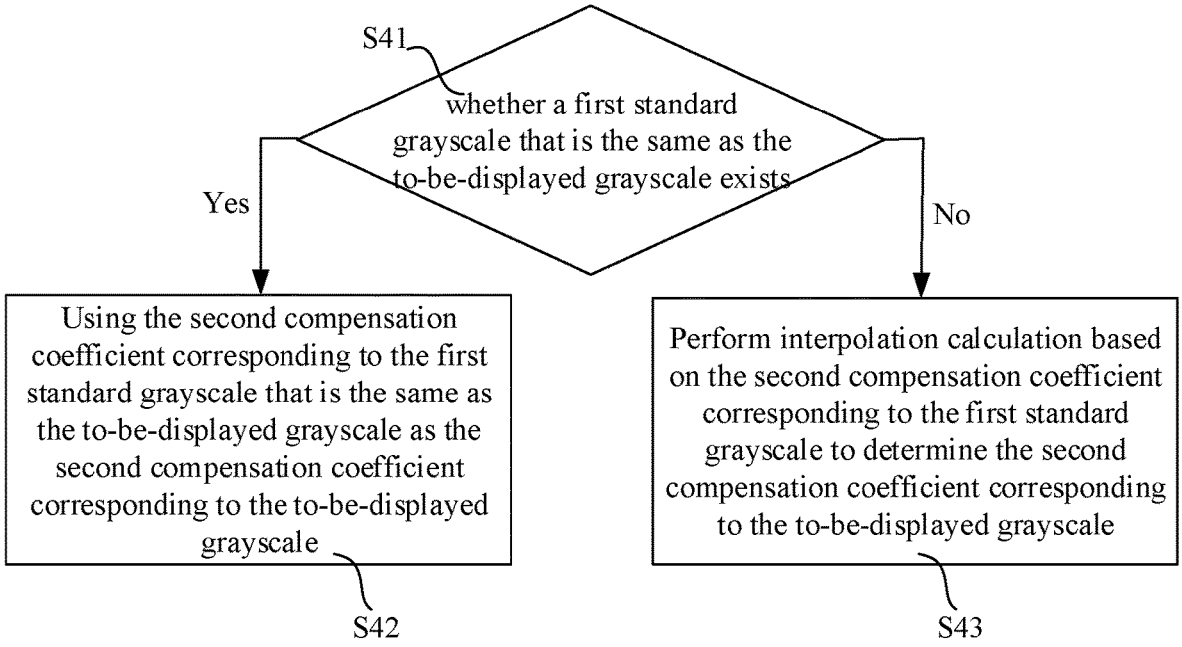
FIG. 5 is a schematic flowchart of a method for determining a second compensation coefficient corresponding to a to-be-displayed grayscale according to some embodiments of the present disclosure.

FIG. 5 is a schematic flowchart of the method for determining the second compensation coefficient corresponding to the to-be-displayed grayscale according to some embodiments of the present disclosure. The method includes determining whether a first standard grayscale that is the same as the to-be-displayed grayscale exists (S41), if the first standard grayscale that is the same as the to-be-displayed grayscale exists, using the second compensation coefficient corresponding to the first standard grayscale that is the same as the to-be-displayed grayscale as the second compensation coefficient corresponding to the to-be-displayed grayscale (S42), and if the first standard grayscale that is the same as the to-be-displayed grayscale does not exist, performing interpolation calculation based on the second compensation coefficient corresponding to the first standard grayscale to determine the second compensation coefficient corresponding to the to-be-displayed grayscale (S43). Two different first standard grayscales may be selected. The interpolation operation may be performed based on second compensation coefficients corresponding to the two first standard grayscales. Thus, the second compensation coefficients corresponding to the to-be-displayed grayscales may be obtained.

In order to reduce the data collection amount and the data processing amount of the light-emitting test, some grayscales may be selected from 1-255 as the second standard grayscales to determine the corresponding second data voltages. Therefore, in the method shown in FIG. 4, a method for obtaining the second data voltage based on the compensation grayscale is shown in FIG. 6.

Figure 6:
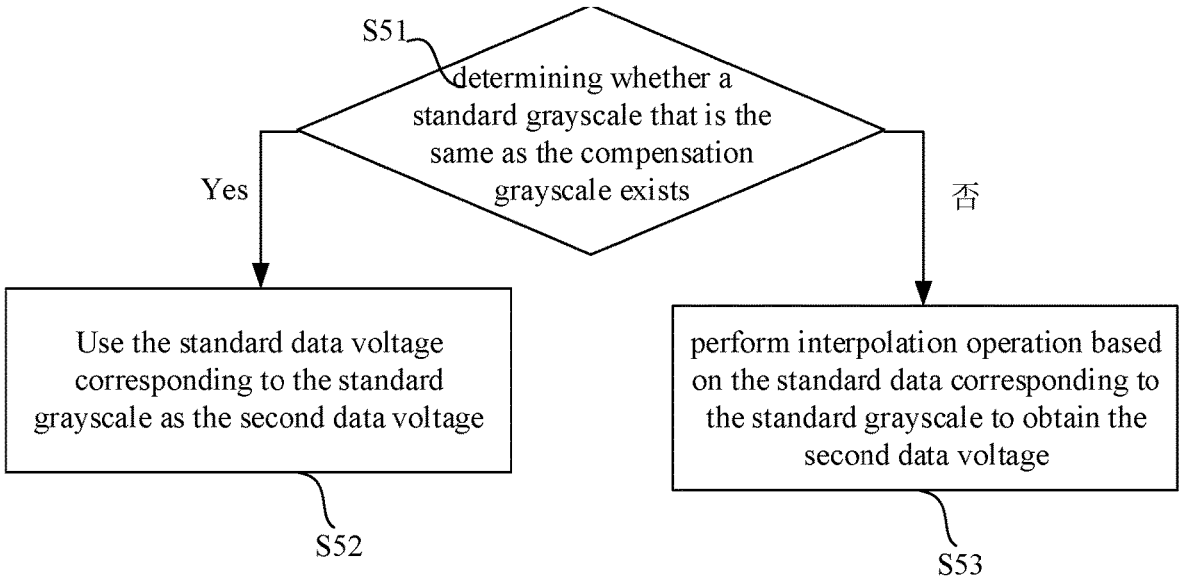
FIG. 6 is a schematic flowchart of a method for obtaining a second data voltage based on a compensation grayscale according to some embodiments of the present disclosure.

FIG. 6 is a schematic flowchart of the method for obtaining the second data voltage based on the compensation grayscale according to some embodiments of the present disclosure. The method includes determining whether a standard grayscale that is the same as the compensation grayscale (i.e., the second standard grayscale) exists (S51), if the standard grayscale that is the same as the compensation grayscale exists, use the standard data voltage corresponding to the standard grayscale as the second data voltage (S52), and if a standard grayscale that is the same as the compensation grayscale does not exist, performing interpolation operation based on the standard data corresponding to the standard grayscale to obtain the second data voltage (S53). Two different second standard grayscales may be selected. The interpolation calculation may be performed based on the second data voltages corresponding to the two second standard grayscales. Thus, the second data voltages corresponding to the compensation grayscales may be obtained.

In the method shown in FIG. 6, the test does not need to be performed on all the 1-255 grayscales to obtain the corresponding second data voltages, which reduces the data collection amount and the data processing amount in the light-emitting test. When no standard grayscale that is the same as the compensation grayscale exists, the second data voltage corresponding to the compensation grayscale may be obtained through the interpolation calculation. The calculation manner may be simple, and the data processing amount may be small.

The display drive method of embodiments of the present disclosure further includes storing a compensation coefficient corresponding to the compensation manner. The compensation coefficient may include the first compensation coefficient and the second compensation coefficient. The compensation coefficient may be used to determine the data voltage required by the to-be-displayed sub-pixel. Thus, the display compensation may be performed based on the selected first compensation manner or second compensation manner to solve the display color deviation problem.

Figure 7:
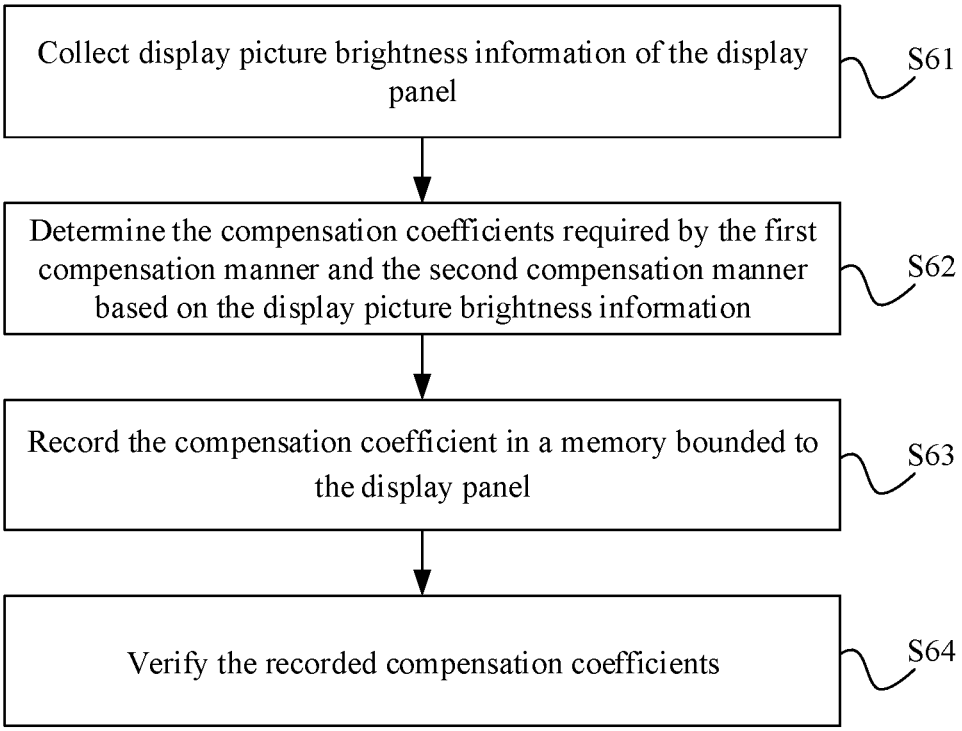
FIG. 7 is a schematic flowchart of a method for obtaining a compensation coefficient according to some embodiments of the present disclosure.

In embodiments of the present disclosure, the method for obtaining the compensation coefficient is shown in FIG. 7.

FIG. 7 is a schematic flowchart of the method for obtaining the compensation coefficient according to some embodiments of the present disclosure. The method includes the following processes.

At S61, display picture brightness information of the display panel is collected.

After the display panel is powered on, the actual display brightness under a non-zero grayscale may be collected by a charge coupled device (CCD).

At S62, the compensation coefficients required by the first compensation manner and the second compensation manner are determined based on the display picture brightness information.

The compensation coefficients required by the first compensation manner and the second compensation manner may be calculated by the existing Demura calculation method.

At S63, the compensation coefficient is recorded in a memory bounded to the display panel.

The memory may be Flash. The first compensation coefficient required by the first compensation manner and the second compensation coefficient required by the second compensation manner may be combined and recorded in the memory.

At S64, the recorded compensation coefficients are verified. After the verification is completed, the display panel is powered off.

In the method shown in FIG. 7, the compensation coefficients required by the first compensation manner and the second compensation manner may be obtained by performing light-emitting display on the display panel based on the detection apparatus required by the existing compensation method. The apparatus has good compatibility, and the method is simple.

In the existing Demura compensation method, the three sub-pixels at 0 grayscale may have the same standard dark state data voltage VGMP. In the technical solution of the present disclosure, by modifying the Demura process, compensation may be performed on the non-zero grayscale by the second compensation manner or the first compensation manner. Each of the first compensation manner and the second compensation manner may have a set of compensation coefficients. The two sets of compensation coefficients may be recorded in the Flash together. At 0 grayscale, a ratio of the data voltages of the three sub-pixels may be adjusted by the first compensation manner to reduce or even eliminate the smear color deviation problem.

In the display drive method of embodiments of the present disclosure, the display compensation may be performed at 0 grayscale and non-0 grayscale by the first compensation manner and the second compensation manner. Each of the two compensation manners may have a set of independent compensation coefficients, which may reduce the reddishness smear problem of the OLED display panel when the OLED display panel displays at the low grayscale.

In the existing compensation manner, the three sub-pixels may use the same standard dark state data voltage VGMP at 0 grayscale. In the technical solution of the present disclosure, when the to-be-displayed grayscale is 0 grayscale, and the display compensation is performed based on the first compensation manner, the three sub-pixels may have different dark state data voltages at 0 grayscale. By compensating the data voltage ratio of the three sub-pixels at 0 grayscale through the first compensation manner, the light-emitting efficiency of the green sub-pixel G may be increased during the picture switch process, and/or the light-emitting efficiency of the red sub-pixel R may be reduced during the picture switch process. Thus, the efficiency differences among the light-emitting efficiencies of the three sub-pixels may be reduced, and the color deviation problem may be solved.

The display drive method of the present disclosure and the existing compensation method are described in comparison with specific display data.

TABLE 1

| | Manner 1: Dark state brightness 0.0012 | Manner 2: Dark state brightness 0.0005 |
|---|---|---|
| R | 82.4% | 82.6% |
| G | 25.3% | 36.5% |
| B | 72.2% | 73.0% |
| W | 40.5% | 48.6% |
| ΔRG | 57.1% | 46.1% |

In Table 1, Manner 1 represents the existing Demura compensation method, and Manner 2 represents the display drive method of the present disclosure.

In the existing manner, the three sub-pixels have the same standard dark state voltage VGMP, for example, VGMP may be set to 6.8V. Thus, the dark state brightness corresponding to the green sub-pixel G is 0.0012. The brightnesses of the three sub-pixels in a first frame are 82.4%, 25.3%, and 72.2%, respectively, the brightness of the white light is 40.5%, and the brightness difference between the red sub-pixel and the green sub-pixel is 57.1%. In the display drive method embodiments of the present disclosure, the brightnesses of the three sub-pixels in the first frame are 82.6%, 36.5%, and 73.0%, respectively, the brightness of the white light is 48.6%, and the brightness difference between the red sub-pixel and the green sub-pixel is 46.1%. By modifying the Demura process and setting the first compensation coefficient, the dark state data voltage of the green sub-pixel G pixel at 0 grayscale may be modified to 6.3V (dark state brightness is 0.0005) to improve the light-emitting efficiency of the green sub-pixel G. Through the test, the brightness of the first frame of the green sub-pixel G will increase by 11%.

TABLE 2

| | Manner 1 | Manner 2 | Data voltage at 0 grayscale after compensation |
|---|---|---|---|
| R | 82.4% | 75.4% | 7.1 V |
| G | 25.3% | 25.3% | 6.8 V |
| B | 72.2% | 73.0% | 6.8 V |
| W | 40.5% | 48.6% | |
| ΔRG | 57.1% | 50.1% | |

In Table 2, Manner 1 represents the existing Demura compensation method, and Manner 2 represents the display drive method of the present disclosure. In the display drive method of embodiments of the present disclosure, the blue sub-pixel B and the green sub-pixel G may have the same standard dark state voltage VGMP. By modifying the Demura process, the data voltage of the red sub-pixel R is set to 7.1V at 0 grayscale through the determined first compensation coefficient. The light-emitting efficiency of the red sub-pixel R may be reduced. Through the test, the brightness of the red sub-pixel R in the first frame may be reduced by 8%. By improving the dark state data voltage of the red sub-pixel R at 0 grayscale, the smear color deviation problem may be weakened and even eliminated.

TABLE 3

| | Manner 1 | Manner 2 | Data voltage at 0 grayscale after compensation |
|---|---|---|---|
| R | 82.4% | 75.4% | 7.1 V |
| G | 25.3% | 43.3% | 6.1 V |
| B | 72.2% | 73.0% | 6.8 V |
| W | 40.5% | 48.6% | |
| ΔRG | 57.1% | 32.1% | |

In Table 3, Manner 1 represents the existing Demura compensation method, and Manner 2 represents the display drive method of the present disclosure. In the display drive method of embodiments of the present disclosure, the first compensation coefficient corresponding to the blue sub-pixel B may be equal to 0. The standard dark state voltage VGMP may be used at 0 grayscale. By modifying the Demura process, the data voltage of the sub-pixel R is modified to 7.1V at 0 grayscale, which reduces the light-emitting efficiency of the red sub-pixel R. Through the test, the brightness of the red sub-pixel R in the first frame is reduced by 7%. The dark state data voltage of the green sub-pixel G is modified to 6.1V at 0 grayscale, which increases the light-emitting efficiency of the green sub-pixel G. Through the test, the brightness of the green sub-pixel Gin the first frame is increased by 18%, while the black state brightness is ensured to be within 0.0005 to meet the dark state display requirement. By increasing the dark state data voltage of the red subpixel R at 0 grayscale and reducing the dark state data voltage of the green subpixel G at 0 grayscale, the smear color deviation problem may be reduced or even eliminated.

Embodiments of the present disclosure further provide a display driver configured to execute the display drive method described above. The display driver is shown in FIG. 8.

Figure 8:
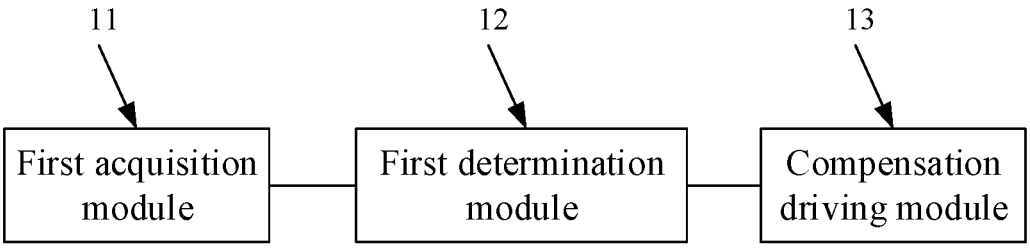
FIG. 8 is a schematic structural diagram of a display driver according to some embodiments of the present disclosure.

FIG. 8 is a schematic structural diagram of the display driver according to some embodiments of the present disclosure. The display driver includes a first acquisition module 11, a first determination module 12, and a compensation driving module 13.

The first acquisition module 11 may be configured to obtain the to-be-displayed grayscale of the to-be-displayed sub-pixel.

The first determination module 12 may be configured to select a suitable compensation manner based on the to-be-displayed grayscale.

The compensation drive module 13 may be configured to provide a data voltage for the to-be-displayed sub-pixel based on the selected compensation manner.

The compensation manner may include the first compensation manner and the second compensation manner. If the to-be-displayed grayscale is 0 grayscale, the first compensation manner may be selected. If the to-be-displayed grayscale is greater than 0 grayscale, the second compensation method may be selected. The first compensation manner may be used to reduce a difference between light-emitting efficiencies of sub-pixels with different light-emitting colors under the same grayscale.

The display driver of embodiments of the present disclosure may be configured to execute the display drive method above. The display compensation may be performed on the to-be-displayed sub-pixel at the 0 grayscale by the first compensation manner, and the display compensation may be performed on the to-be-displayed sub-pixel at a non-zero grayscale greater than 0 grayscale by the second compensation manner. In the first compensation manner, the difference between the light-emitting efficiencies of the sub-pixels of different light-emitting colors may be reduced. Thus, the display color deviation problem caused by different light-emitting efficiency decay rates may be solved when the sub-pixels of different light-emitting colors are at the low grayscale.

When the to-be-displayed grayscale is 0 grayscale, the compensation drive module 13 may be configured to obtain the pre-stored first compensation coefficient, calculate the first data voltage based on the first compensation coefficient and the standard dark state data voltage calibrated at 0 grayscale, and control the light-emitting state of the to-be-displayed sub-pixel based on the first data voltage. The first data voltage may be different from the standard dark state data voltage to change the light-emitting efficiency of the sub-pixel and reduce the difference between light-emitting efficiencies of the sub-pixels of different light-emitting colors. The display panel may include a first sub-pixel, a second sub-pixel, and a third sub-pixel of different light-emitting colors from each other. The first compensation coefficients of the three sub-pixels may not be the same. By adjusting the first compensation coefficients, compensation may be performed on the standard dark state data voltage of the sub-pixel calibrated at 0 grayscale. Thus, the data voltages of the three sub-pixels may be different at 0 grayscale. By setting the first compensation coefficient, the light-emitting efficiency curve of the sub-pixel with a larger low grayscale light-emitting efficiency decay rate may be shifted upward. Thus, the difference between the light-emitting efficiencies of the sub-pixels of different colors at the low grayscale may be reduced, the display color deviation problem may be solved, and the smear color deviation problem may be improved.

When the to-be-displayed grayscale is greater than 0 grayscale, the compensation drive module 13 may be configured to obtain the second compensation coefficient corresponding to the to-be-displayed grayscale, calculate the compensation grayscale based on the to-be-displayed grayscale and the corresponding second compensation coefficient, obtain the second data voltage based on the compensation grayscale, and control the to-be-displayed sub-pixel to perform light-emitting display based on the second data voltage. Thus, the compensation grayscale may be calculated based on the to-be-displayed grayscale and the corresponding second compensation coefficient. The second data voltage may be determined based on the compensation grayscale. The to-be-displayed sub-pixel may be controlled to perform light-emitting display based on the second data voltage. When the to-be-displayed grayscale is greater than 0, compensation may be performed on the to-be-displayed grayscale to convert the to-be-displayed grayscale into the compensation grayscale to drive the light-emitting display. Thus, the display color deviation problem that exists in the to-be-displayed grayscale greater than 0 may be reduced.

Figure 9:
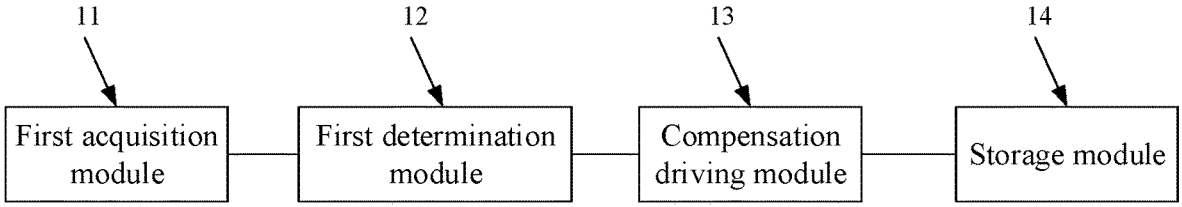
FIG. 9 is a schematic structural diagram of another display driver according to some embodiments of the present disclosure.

FIG. 9 is a schematic structural diagram of another display driver according to some embodiments of the present disclosure. Based on the method shown in FIG. 8, the display driver shown in FIG. 9 further includes a storage module 14. The storage module 14 may be configured to store the compensation coefficient corresponding to the compensation manner. The compensation coefficient may be used to determine the data voltage required by the to-be-displayed sub-pixel. Thus, the display compensation may be performed based on the selected first compensation manner or second compensation manner to solve the display color deviation problem.

Based on display drive method embodiments and display driver embodiments, embodiments of the present disclosure further provide a display device. The display device is shown in FIG. 10.

Figure 10:
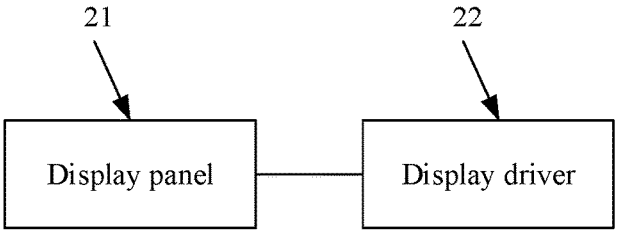
FIG. 10 is a schematic structural diagram of a display device according to some embodiments of the present disclosure.

FIG. 10 is a schematic structural diagram of the display device according to some embodiments of the present disclosure. The display device includes a display panel 21 and the display driver 22 of embodiments of the present disclosure. The display driver 22 may be configured to drive the display panel to perform light-emitting display. The display panel 21 may include an OLED display panel.

In embodiments of the present disclosure, the display device includes, but is not limited to, a smartphone, a tablet computer, a laptop, an all-in-one computer, a wearable device with a display function, etc.

The display device may include the display driver of embodiments of the present disclosure. The display device may perform the display compensation through the above display drive method. When the display device displays at the low grayscale, the display color deviation problem caused by the difference between the light-emitting efficiency decay rates of the sub-pixels of different light-emitting colors may be reduced, and the display quality may be improved.

The technical solution of the present disclosure provides the display drive method, display driver, and display device. According to the technical solution of the present disclosure, a suitable compensation manner may be selected based on the to-be-displayed grayscale of the to-be-displayed sub-pixel to provide the data voltage for the to-be-displayed sub-pixel. The compensation manner includes the first compensation manner and the second compensation manner. When the to-be-displayed grayscale is 0 grayscale, the first compensation manner is selected. When the to-be-displayed grayscale is greater than 0 grayscale, the second compensation manner is selected. The first compensation manner is used to reduce a difference between light-emitting efficiencies of sub-pixels with different light-emitting colors under a same grayscale. In the technical solution of the present disclosure, the display compensation may be performed on the to-be-displayed sub-pixel at 0 grayscale by the first compensation manner and at a non-zero grayscale greater than 0 grayscale by the second compensation manner. With the first compensation manner, the difference between the light-emitting efficiencies of the sub-pixels of different light-emitting colors at the same grayscale. Thus, the display color deviation problem caused by different light-emitting efficiency decay rates of the sub-pixels of different light-emitting colors at the low grayscale may be solved.

Embodiments in this specification are described in a progressive, or parallel, or progressive and parallel manner. Each embodiment focuses on a difference from other embodiments. For same and similar parts between embodiments, references may be made to each other. For the display driver and display device of embodiments of the present disclosure, since the display driver and display device correspond to the display drive method of embodiments of the present disclosure, the descriptions are relatively simple. For relevant details, references may be made to the corresponding descriptions of the display drive method.

In the description of the present disclosure, the drawings and descriptions of embodiments of the present disclosure are illustrative rather than restrictive. A same reference number throughout embodiments of the specification may identify a same structure. In addition, to facilitate understanding and description, the drawings may exaggerate thicknesses of some layers, films, panels, regions, etc. When an element such as a layer, film, region, or substrate is referred to as being "on" another element, the element can be directly on the other element, or an intermediate element may exist. In addition, "on" may mean that an element may be positioned on or below another element, but does not essentially mean that the element is positioned on an upper side of the another element according to the gravity directions.

An orientation or positional relationship indicated by the terms "upper," "lower," "top," "bottom," "inner," "outer," etc., is based on the orientation or positional relationship shown in the accompanying drawings, and is only to facilitate describing the present disclosure and simplifying the description, rather than to indicate or imply that the device or element referred to must have a particular orientation, be constructed and operate in a particular orientation, and therefore should not be considered as a limitation of the present disclosure. When a component is considered to be "connected" to another component, the component may be directly connected to the other component or an intermediate component may exist at the same time.

In the present specification, a relational term such as first and second is used only to distinguish one entity or operation from another, and does not necessarily require or imply such actual relationship or order between those entities or operations. Moreover, the terms "including," "comprising." or any other variation thereof are intended to encompass a non-exclusive inclusion. Thus, an article or device comprising a list of elements includes not only those elements, but also other elements not expressly listed, or also include elements inherent to the article or device. Without further limitation, an element defined by the phrase "including a . . . " does not preclude the presence of an identical element in addition to the article or device included above.

The above description of embodiments of the present disclosure enables those skilled in the art to make or use the present disclosure. Various modifications to embodiments of the present disclosure are apparent to those skilled in the art. The generic principle defined herein may be implemented in other embodiments without departing from the spirit or scope of the present disclosure. Therefore, the present disclosure is not intended to be limited to embodiments of the present disclosure shown herein, but conforms to the widest scope consistent with the principles and novel features disclosed herein.

What is claimed is:

1. A display drive method, applied to a display panel, the display panel having a subpixel used for image display, comprising:

obtaining a to-be-displayed grayscale of a to-be-displayed subpixel;

selecting a suitable compensation manner based on the to-be-displayed grayscale; and providing a data voltage for the to-be-displayed sub-pixel based on the selected compensation manner;

wherein:

the compensation manner includes a first compensation manner and a second compensation manner;

in response to the to-be-displayed grayscale being 0 grayscale, the first compensation manner is selected;

in response to the to-be-displayed grayscale being greater than 0 grayscale, the second compensation manner is selected; and the first compensation manner is used to reduce a difference between light-emitting efficiencies of sub-pixels with different light-emitting colors under a same grayscale.

2. The method according to claim 1, wherein in response to the to-be-displayed grayscale being 0 grayscale, providing the data voltage for the to-be-displayed sub-pixel based on the first compensation manner includes:

obtaining a pre-stored first compensation coefficient;

calculating a first data voltage based on the first compensation coefficient and a standard dark state data voltage calibrated at 0 grayscale; and controlling a light-emitting state of the to-be-displayed sub-pixel based on the first data voltage;

wherein the first data voltage is different from the standard dark state data voltage to change the light-emitting efficiencies of the sub-pixels and reduce the difference between the light-emitting efficiencies of the sub-pixels with different light-emitting colors.

3. The method according to claim 2, wherein calculating the first data voltage includes:

obtaining the first data voltage by adding the first compensation coefficient and the standard dark state data voltage.

4. The method according to claim 2, wherein:

the display panel includes a first sub-pixel, a second sub-pixel, and a third sub-pixel, which have different light-emitting colors;

in response to the to-be-displayed grayscale displaying a low grayscale threshold, for a same to-be-displayed grayscale, light-emitting efficiency decay rates of the first sub-pixel, the second sub-pixel, and the third sub-pixel decrease in sequence; and a first compensation coefficient corresponding to the first sub-pixel is greater than 0, and/or a first compensation coefficient corresponding to the third sub-pixel is smaller than 0.

5. The method according to claim 4, wherein a first compensation coefficient corresponding to the second sub-pixel is 0.

6. The method according to claim 1, wherein in response to the to-be-displayed display grayscale being greater than 0 grayscale, providing the data voltage for the to-be-displayed sub-pixel based on the second compensation manner includes:

obtaining a second compensation coefficient corresponding to the to-be-displayed grayscale;

calculating a compensation grayscale based on the to-be-displayed grayscale and the corresponding second compensation coefficient;

obtaining a second data voltage based on the compensation grayscale; and controlling the to-be-displayed sub-pixel to perform light-emitting display based on the second data voltage.

7. The method according to claim 6, wherein the sub-pixels of different light-emitting colors have a same second compensation coefficient at a same to-be-displayed grayscale.

8. The method according to claim 6, wherein calculating the compensation grayscale includes:

obtaining the compensation grayscale by adding the to-be-displayed grayscale and the corresponding second compensation coefficient.

9. The method according to claim 6, wherein obtaining the second data voltage based on the compensation grayscale includes:

determining whether a standard grayscale that is same as the compensation grayscale exists;

if yes, using a standard data voltage corresponding to the standard grayscale as the second data voltage; and if not, obtaining the second data voltage by performing interpolation calculation based on the standard data voltage corresponding to the standard grayscale.

10. The method according to claim 1, further comprising:

storing a compensation coefficient corresponding to the compensation manner;

wherein the compensation coefficient is used to determine the data voltage required by the to-be-displayed sub-pixel.

11. The method according to claim 10, wherein obtaining the compensation coefficient includes:

collecting display picture brightness information of the display panel;

determining compensation coefficients required by the first compensation manner and the second compensation manner based on the display picture brightness information;

recording the compensation coefficients in a memory bounded to the display panel; and verifying the recorded compensation coefficients.

12. A display driver comprising:

a first acquisition module configured to obtain a to-be-displayed grayscale of a to-be-displayed sub-pixel;

a first determination module configured to select a suitable compensation manner based on the to-be-displayed grayscale; and a compensation drive module configured to provide a data voltage for the to-be-displayed sub-pixel based on the selected compensation manner;

wherein:

the compensation manner includes a first compensation manner and a second compensation manner;

in response to the to-be-displayed grayscale being 0 grayscale, the first compensation manner is selected;

in response to the to-be-displayed grayscale being greater than 0 grayscale, the second compensation manner is selected; and the first compensation manner is used to reduce a difference between light-emitting efficiencies of sub-pixels with different light-emitting colors under a same grayscale.

13. The display driver according to claim 12, wherein in response to the to-be-displayed grayscale being 0 grayscale, the compensation drive module is configured to:

obtain a pre-stored first compensation coefficient;

calculate a first data voltage based on the first compensation coefficient and a standard dark state data voltage calibrated at 0 grayscale; and control a light-emitting state of the to-be-displayed sub-pixel based on the first data voltage;

wherein the first data voltage is different from the standard dark state data voltage to change the light-emitting efficiencies of the sub-pixels and reduce the difference between the light-emitting efficiencies of the sub-pixels of different light-emitting colors.

14. The display driver according to claim 12, wherein in response to the to-be-displayed grayscale being greater than 0 grayscale, the compensation drive module is configured to:

obtain a pre-stored second compensation coefficient;

calculate a compensation grayscale based on the second compensation coefficient and the to-be-displayed grayscale;

obtain a second data voltage based on the compensation grayscale; and control the to-be-displayed sub-pixel to perform light-emitting display based on the second data voltage.

15. The display driver according to claim 12, further comprising:

a storage module configured to store a compensation coefficient corresponding to the compensation manner, the compensation coefficient being used to determine the data voltage required by the to-be-displayed sub-pixel.

16. A display device comprising:

a display panel; and a display driver including:

a first acquisition module configured to obtain a to-be-displayed grayscale of a to-be-displayed sub-pixel;

a first determination module configured to select a suitable compensation manner based on the to-be-displayed grayscale; and a compensation drive module configured to provide a data voltage for the to-be-displayed sub-pixel based on the selected compensation manner;

wherein:

the compensation manner includes a first compensation manner and a second compensation manner;

in response to the to-be-displayed grayscale being 0 grayscale, the first compensation manner is selected;

in response to the to-be-displayed grayscale being greater than 0 grayscale, the second compensation manner is selected; and the first compensation manner is used to reduce a difference between light-emitting efficiencies of sub-pixels with different light-emitting colors under a same grayscale.

* * * * *